United States Patent [19]

Mickelson

[11] 4,142,369

[45] Mar. 6, 1979

[54] MULTIPLE SPEED HOISTING SYSTEM WITH PRESSURE PROTECTION AND LOAD CONTROL

[75] Inventor: Roger D. Mickelson, Cedar Rapids, Iowa

[73] Assignee: FMC Corporation, San Jose, Calif.

[21] Appl. No.: 683,113

[22] Filed: May 4, 1976

[51] Int. Cl.[2] ..... F01C 11/00; F15B 13/06

[52] U.S. Cl. ..... 60/425; 60/483; 60/DIG. 2; 91/420; 91/436

[58] Field of Search ..... 91/420, 416, 412, 414, 91/433, 436, 437, 438, 439; 60/425, DIG. 2, 483

[56] References Cited

U.S. PATENT DOCUMENTS

| | | | |
|---|---|---|---|
| 2,431,032 | 11/1947 | Ernst | 91/436 X |
| 2,500,627 | 3/1950 | Chinn | 91/412 X |
| 2,800,110 | 7/1957 | Haarmeyer | 91/436 X |
| 3,018,902 | 1/1962 | Minty | 91/420 X |
| 3,313,316 | 4/1967 | Thomas | 91/437 X |
| 3,335,739 | 8/1967 | Rice | 91/437 X |
| 3,768,263 | 10/1973 | Olson et al. | 91/412 X |
| 3,788,076 | 1/1974 | Lansky et al. | 60/DIG. 2 |
| 3,824,896 | 7/1974 | Tull | 91/436 |
| 3,864,915 | 2/1975 | Metailler | 60/DIG. 2 |

*Primary Examiner*—Irwin C. Cohen

*Attorney, Agent, or Firm*—J. W. Edwards; J. F. Verhoeven

[57] ABSTRACT

A multiple speed hoisting system has a first fluid circuit, with a maximum effective cross-sectional area for hoisting heavy loads at low speed, and a second fluid circuit, with a smaller effective cross-sectional area for hoisting lighter loads at higher speed. These circuits are separately actuated by a valve that is responsive to a regulating means for selectively positioning the valve. A pressure operated control, that is in flow communication with the second fluid circuit, automatically cancels the influence of the valve regulating means, in response to a predetermined pressure level in the second fluid circuit, and allows the valve to revert to a position actuating the first fluid circuit. Undesirable oscillations within the system between the pressure operated control and the valve regulating means are avoided. In a preferred embodiment of the invention, a pressure switch is the pressure operated control, a solenoid that is actuated by a manual control switch forms the regulating means for selectively positioning the valve, and a relay is provided to stabilize the electrical control circuit, thereby prevent hunting between the pressure switch and the solenoid controlled valve.

5 Claims, 2 Drawing Figures

MULTIPLE SPEED HOISTING SYSTEM WITH PRESSURE PROTECTION AND LOAD CONTROL

BACKGROUND OF THE INVENTION

1. Field of the Invention

This invention relates to a multiple speed load hoisting system. More specifically, it relates to such a system with fluid pressure for hoisting a load, a manual control for shifting from a low lifting speed to a high lifting speed, and a safety device, that is responsive to excess fluid pressure at a high lifting speed, for automatically cancelling the influence of the manual control and allowing reversion to a low lifting speed.

2. Description of the Prior Art

Fluid cylinders and fluid motors have been used as components for hoisting loads at multiple speeds. Such components usually have two different effective areas that can be utilized for hoisting. A maximum effective area is provided for hoisting heavy loads at low speed, and a smaller effective area is provided for hoisting lighter loads at higher speed. A manual control enables an operator to shift from low speed to high speed, but a problem results when the load being hoisted is greater than the maximum design load for high speed operation. Fluid pressure within the components can be manified to the point of component failure by such shifting of the manual control.

Some fluid circuits for operating multiple speed hoisting components, such as fluid cylinders and fluid motors, have a pressure relief valve, that is located between the component and a holding valve, to prevent the component pressure from climbing too high. While this relief valve protects the components from high pressures, it allows fluid to escape, from the relief valve back to a sump tank, and thus, lowers the load being hoisted.

SUMMARY OF THE INVENTION

An object of the present invention is to provide pressure protection for load hoisting components in a fluid circuit, while maintaining load control. Another object of the invention is to provide a safety circuit, that automatically cancels the influence of a manual control in response to excessive pressure. A further object of the invention is to provide an automatic control system without undesirable oscillation.

A control, responsive to excessive pressure in a fluid circuit for hoisting light loads at high speed, automatically cancels the influence of a manual control for selecting a hoisting speed. Thus, this pressure operated control allows a valve to revert to a position actuating a fluid circuit for hoisting heavy loads at low speed. Load hoisting components, such as fluid cylinders or fluid motors, are protected by the control against excessive pressure, while the hoisting system maintains control of the load being hoisted. In a preferred embodiment of this invention, a pressure switch is the pressure operated control, a manual control switch is the manual control for selecting the hoisting speed, a solenoid regulates the valve in response to the switches, and a relay stabilizes the electrical control circuit to prevent hunting between the pressure switch and the solenoid controlled valve.

DESCRIPTION OF THE PREFERRED EMBODIMENTS

Figure 1:
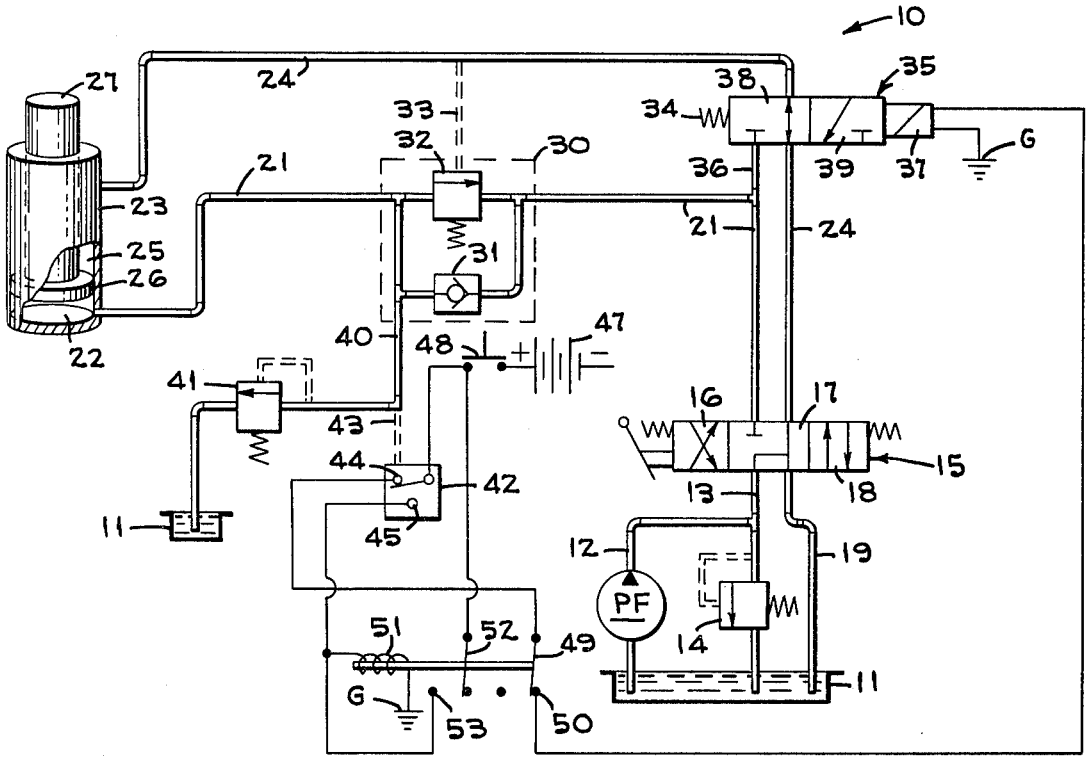
FIG. 1 is a schematic illustration of the hydraulic and electrical circuitry for a multiple speed hoisting system that embodies the present invention with a fluid cylinder as a load hoisting component.

Looking now at FIG. 1, a multiple speed hoisting system 10 has a sump tank 11 from which hydraulic fluid is drawn through a line 12 by a fixed displacement pump PF. The available horsepower of this pump limits the fluid flow that can be directed from the pump, continuing through the line 12, to a feed line 13. A circuit relief valve 14 is provided in the feed line, between the sump tank 11 and the connection with line 12, to enable fluid to return to the sump tank when fluid pressure within the feed line exceeds a preset amount. At the end of the feed line, opposite from the sump tank, is a manual control valve 15 that has a hoist-down position 16, a holding position 17, and a hoist-up position 18. This valve is connected with a drain line 19 that returns fluid to the sump tank. Within the holding position of the valve, the feed line is opened to the drain line.

Extending from the manual control valve 15, on the opposite side of the valve from the feed line 13, is a hoist-up line 21, that is connected to an extend chamber 22 within the hoist cylinder 23, and a hoist-down line 24, that is connected to a retract chamber 25 within the hoist cylinder. A piston 26 is slidably fitted within the hoist cylinder. This piston separates the extend chamber from the retract chamber. A cylinder rod 27 is connected to the piston. This rod has a single end that extends from the hoist cylinder for supporting loads to be hoisted. Thus, it will be seen that when the manual control valve is in the hoist-up position 18, fluid from the feed line pressurizes the hoist-up line, and fluid from the hoist-down line drains through the valve to the drain line 19. In the holding position 17, fluid is blocked in the hoist-up line by the valve, while the hoist-down line is allowed to drain through the valve to the sump tank 11. In the hoist-down position 16, the hoist-down line is pressurized and the hoist-up line is allowed to drain to the sump tank.

A holding valve 30 is provided in the hoist-up line 21. Within the holding valve, the hoist-up line has two separate branches. One branch has a check valve 31 to prevent a reversal of fluid flow due to loading on the cylinder rod when the manual control valve 15 is in either the hoist-up position 18 or the holding position 17. The other branch of the hoist-up line, within the holding valve, has a shut-off valve 32 that is normally held by a spring in a closed position. This shut-off valve is opened by pressure, through a pilot line 33, when the hoist-down line 24 is pressurized by moving the manual control valve to the hoist-down position 16.

A solenoid controlled valve 35 is provided in the hoist-down line 24. This valve makes connection with a supplemental fluid supply line 36 that can feed the hoist-up line 21 from the hoist-down line. The valve is controlled by a solenoid 37 to shift from a first fluid circuit position 38 to a second fluid circuit position 39. Upon deactivation of the solenoid, the valve is returned by a spring 34 to the first fluid circuit position. In the first fluid circuit position, fluid from the hoist-down line flows through the valve to the sump tank and the supplemental fluid supply line 36 is blocked. In the second fluid circuit position, flow from the retract chamber 25 through the hoist-down line is diverted through the valve into the supplemental fluid supply line, while the other connection of the valve with the hoist-down line is blocked.

When the annual control valve 15 is in the hoist-up position 18 and the solenoid controlled valve 35 is in the first fluid circuit position 38, a first fluid circuit for hoisting heavy loads at low speed is formed. In this circuit, pressurized fluid from the pump PF flows through the lines 12, 13 and 21 to the extend chamber 22 of the hoist cylinder 23. The retract chamber 25 of the hoist cylinder is vented through the lines 24 and 19 to the sump tank 11. Since the fluid in the extend chamber 22 is under pressure and the retract chamber 25 is vented, the full cross-sectional area of the piston 26 is effective for hoisting loads on the cylinder rod 27. The speed at which a load is elevated by the piston is a direct function of the available flow, supplied by the pump PF under the piston loading, divided by the effective area of the piston. When the load being elevated is less than the maximum loading capacity of the hoist, the pressure on the discharge side of the pump is less than maximum, and horsepower is available for hoisting the load faster. To utilize this available horsepower, when the loading is substantially reduced, it is necessary to increase the pressure on the discharge side of the pump and to increase the quantity of flow to the piston. This can be achieved by decreasing the effective area of the piston.

When the solenoid controlled valve 35 is shifted to the second fluid circuit position 39, a second fluid circuit for hoisting lighter loads at higher speed is formed. In this circuit, pressurized fluid from the pump PF flows through the lines 12, 13 and 21 to the extend chamber 22 of the hoist cylinder 23. The retract chamber 25 is connected through the lines 24 and 36 to the line 21. Thus, fluid pressure in the retract chamber is substantially the same as the fluid pressure in the extend chamber and only that portion of the piston 26 that corresponds to the cross-sectional area of the piston rod 27 is effective for hoisting loads. The remaining area of the piston is utilized for increasing the pressure and the quantity of flow in the line 21.

The pressure within the extend chamber 22 is equal to the loading on the cylinder rod 27 divided by the effective area of the piston 26, plus an additional amount for dynamic forces. The velocity of the piston is equal to the flow supplied by the pump divided by the effective area of the piston which is the hydraulic component. Assuming that the cross-sectional area of the extend chamber is twice the effective cross-sectional area of the retract chamber, there would be a two to one ratio between for dynamic forces. The velocity of the piston is equal to the flow supplied by the pump divided by the effective area of the piston which is the hydraulic component. Assuming that the cross-sectional area of the extend chamber is twice the effective cross-sectional area of the retract chamber, there would be a two to one rato between high speed and low speed. Similarly, the pressure in the extend chamber during high speed operation would be twice the pressure in that chamber during low speed operation. Thus, if a load was being elevated at low speed and the solenoid valve 35 was shifted into the position 39 for high speed operation, the pressure within the hoist cylinder 23 would double. If the load being elevated was greater than half the hoist capacity for low speed, upon shifting to high speed operation, the hoist cylinder would be overloaded.

To prevent excessive pressure within the hoist cylinder 23, a pressure relief line 40 extends from the hoist-up line 21, at a location between the hoist cylinder and the holding valve 30, to the sump tank 11. Within this line, a normally closed component relief valve 41 opens, when the pressure reaches a preset amount, to allow fluid to flow to the sump tank. While such discharging of fluid protects the hoist cylinder from excessive pressure, it also allows the load being hoisted to force the hoist cylinder rod 27 downward. Thus, the load would be out of control by the cylinder rod.

A pressure switch 42 is connected by a pilot line 43 to the pressure relief line 40 at a location between the component relief valve 41 and the hoist-up line 21. This switch is normally in a position closing a circuit with a solenoid-make contact 44, but when the pressure within the pilot line reaches a predetermined level, the switch shifts to a position closing a circuit with a circuit relay-break contact 45. The predetermined level of pressure required to cause the pressure switch to break away from the solenoid-make contact is more than the pressure required to actuate the circuit relief valve 14 but less than the pressure required to actuate the component relief valve.

The electrical control circuit for actuating the solenoid 37 receives power from a battery 47. This circuit is controlled by an operator's switch 48 that is normally open. When a hoist operator depresses the operator's switch, current normally flows through the pressure switch 42, the solenoid-make contact 44, a relay switch 49, and a contact 50 to the solenoid 37. If the pressure switch has been shifted to the circuit relay-break contact 45, current will flow from that contact through a relay coil 51 to a ground G. The flow of current through the relay coil causes the relay switch 49 to open from the contact 50 and also causes a relay switch 52 to close upon a contact 53. Current then flows directly from the operator's switch, by-passing the pressure switch, to the relay switch 52, the contact 53, the relay coil 51, and the ground G.

The relay switches 49 and 52 are provided within the electrical control circuit to stabilize the circuit and thereby prevent hunting between the pressure switch 42 and the solenoid 37. The relay switches could be eliminated by using a pressure switch with a dead band ratio greater than two to one with hoist cylinders having an extend to retract ratio of two to one. Thus, the pressure switch would break a circuit at a predetermined pressure level but would not remake the circuit until the pressure was less than one-half the predetermined pressure level.

In operation, when the cylinder rod 27 is elevating a load at high speed, the solenoid controlled valve 35 is in the second fluid circuit position 39 and the operator's switch 48 is depressed. Should the pressure developed by the load within the hoist cylinder 23, as sensed through the pressure relief line 40, exceed the predetermined level of the pressure switch 42, the pressure switch will break away from the solenoid-make contact 44 and shift to a position contacting the circuit relay-break contact 45. The relay switch 49 is held open and the relay switch 52 is held closed upon the contact 53 by the relay coil 51. The solenoid 37 is de-energized and the valve 35 is returned by the spring 34 to the first fluid circuit position 38 for lifting the load at high speed. Thus, the pressure switch automatically cancels the influence of the operator's switch. By shifting to low speed, the pressure within the hoist cylinder will be reduced to a safe level but the relay switch 52, which enables the relay coil 51 to remain energized, continues to hold the relay switch 49 open, until the operator's switch 48 is opened. This prevents undesirable oscillations in the system, as would occur if the solenoid 37 could be automatically energized to shift the valve 35 back to the position 39 for high speed.

Since the circuit relief valve 14 is actuated by a pressure lower than the predetermined level required to actuate the pressure switch 42, this valve will open and the pressure switch will not be actuated by pressure coming from the pump PF. The pressure switch is actuated by a pressure level lower than the pressure required to actuate the component relief valve 41, and thus, will be actuated before the component relief valve. This valve will still limit the pressure spike that can occur in the time span required for the solenoid controlled valve 35 to shift back into the position 38 for low speed operation. The actual time span is normally a fraction of a second and thus, very little fluid will be allowed to escape through the component relief valve so that the load on the cylinder rod 27 will remain stable.

Figure 2:
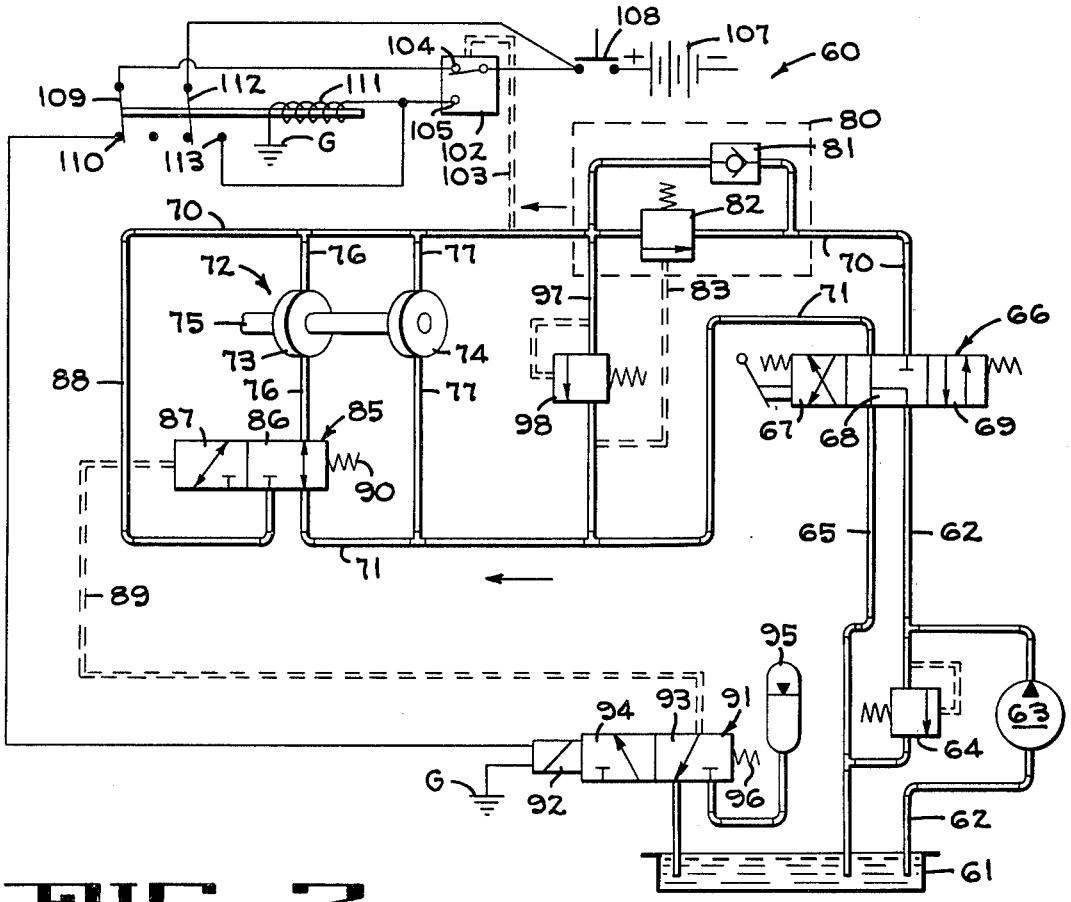
FIG. 2 is a schematic illustration of the hydraulic and electrical circuitry for a modified form of hoisting system with a fluid motor as a load hoisting component.

With reference to FIG. 2, a second embodiment of the invention is illustrated by a multiple speed hoisting system 60. This system has a sump tank 61 from which hydraulic fluid is drawn through a supply line 62 by a fixed displacement pump 63. A circuit relief valve 64 is provided between the line 62, at a location on the discharge side of the pump, and a drain line 65, that returns fluid to the sump tank. Both the supply line and the drain line are connected to a manual control valve 66. This valve has a hoist-down position 67, a holding position 68, and a hoist-up position 69. When the valve is in the holding position, the supply line is opened to the drain line.

On the side of the manual control valve 66, opposite from the supply line 62 and the drain line 65, is a hoist-up line 70 and a hoist-down line 71. These lines extend from the valve to a fluid motor 72 that has a first rotor section 73 and a second rotor section 74 for driving an output shaft 75. Lines 70 and 71 are connected through the first rotor section by a line 76. The lines 70 and 71 are also connected through the second rotor section by a line 77. When the manual control valve is in the hoist-up position 69, fluid flows through the hoist-up line to the motor and returns from the motor through the hoist-down line. In the holding position 68, fluid from the supply line circulates through the valve to the drain line, and the fluid returns through the drain line to the sump tank 61. The hoist-up line is blocked when the valve is in the holding position. In the hoist-down position 67, fluid from the supply line flows through the valve to the hoist-down line, and returns from the fluid motor, through the hoist-up line, to the valve, where it is directed to the drain line leading to the sump tank.

A holding valve 80 is provided in the hoist-up line 70. Within the holding valve, the hoist-up line has two separate branches. One branch has a check valve 81 to prevent a reversal of fluid flow due to loading on the output shaft 75 when the manual control valve 66 is in either the hoist-up position 69 or the holding position 68. The other branch of the hoist-up line has a shut-off valve 82 that is normally held by a spring in a closed position. This valve is opened by pressure, through a pilot line 83, when the hoist-down line 71 is pressurized.

A directional valve 85 is provided in the line 76 between the first rotor section 73 and the hoist-down line 71. This valve has a first fluid circuit position 86 and a second fluid circuit position 87. In the first position, fluid flows directly through the valve along the line 76 for driving the first rotor section simultaneously with the second rotor section 74 at low speed. In the second position, fluid on the discharge side of the first rotor section is coupled through the valve with a pressure equalizing line 88 that returns to the inlet side of the first rotor section. This valve is controlled by fluid pressure in a pilot line 89 and by a return spring 90. The pilot line is coupled to a directional valve 91 that is controlled by a solenoid 92 and a return spring 96. This directional valve has a first position 93, that vents fluid from the pilot line to the sump tank 61, and a second position 94, that directs fluid from a pressure source 95 to the pilot line.

When the manual control valve 66 is in the hoist-up position 69 and the directional valve 85 is in the first fluid circuit position 86, a first fluid circuit for hoisting heavy loads at low speed is formed. In this circuit, pressurized fluid from the pump 63 is directed through the lines 62, 70 and 76 to the first rotor section 73 and through the lines 62, 70 and 77 to the second rotor section 74. Fluid is drained from the rotor sections, through the lines 76, 77, 71 and 65 to the sump tank 61. Since the rotor sections are connected in parallel relationship to drive the output shaft 75, the full cross-sectional area of each rotor section is effective for hoisting loads with the output shaft. The speed at which a load is elevated is a direct function of the available flow, supplied by the pump 63, divided by the effective displacement of the two rotor sections. When the load being elevated is less than the maximum loading capacity of the hoist, the pressure on the discharge side of the pump is less than maximum and horsepower is available for hoisting the load faster. To utilize this available horsepower when the loading is substantially reduced, it is necessary to increase the pressure on the discharge side of the pump and to increase the velocity of flow through the second rotor section 74. This can be achieved by decreasing the effective area of the rotor sections.

When the directional valve 85 is shifted to the second fluid circuit position 87, a second fluid circuit for hoisting lighter loads at higher speed is formed. In this circuit, pressurized fluid from the pump 63 flows through the lines 62, 70 and 77 to drive the second rotor section 74, but the first rotor section 73 is inactivated by the pressure equalizing line 88. The pressure, within the second rotor section and also on the discharge side of the pump, is proportional to the loading on the output shaft 75 divided by the effective displacement of second rotor section. The velocity of flow through the second rotor section is equal to the flow supplied by the pump divided by the effective displacement of the second rotor section.

Assuming that the cross-sectional area of the rotor sections 73 and 74 are equal, there would be a two to one ratio between high speed and low speed. Similarly, the pressure in the second rotor section 74, during high speed operation, would be twice the pressure in the rotor sections, during low speed operation. Thus, if a load was being elevated at low speed and the directional valve 85 was shifted into the position 87 for high speed operation, the pressure within the second rotor section 74 would double. If the load being elevated by the output shaft 75 was greater than half the hoist capacity for low speed, upon shifting to high speed operation, the second rotor section of the hoist motor would be overloaded.

To prevent excessive pressure within the second rotor section 74, a pressure relief line 97 extends from the hoist-up line 70, at a location between the fluid motor 72 and the holding valve 80, to the hoist-down line 71. Within the pressure relief line, a component relief valve 98 opens when the pressure reaches a preset amount to allow fluid to flow to the hoist-down line, the drain line 65, and the sump tank 61. While such discharging of fluid pressure protects the rotor sections 73 and 74, it also allows the load being hoisted to force the output shaft 75 in an opposite direction of rotation. Thus, the load would be out of control by the output shaft.

A pressure switch 102 is connected by a pilot line 103 to the hoist-up line 70 at a location between the pressure relief line 97 and the fluid motor 72. This switch is normally in a position closing a circuit with a solenoid-make contact 104, but when the pressure within the pilot line reaches a predetermined level, the switch shifts to a position closing a circuit with a relay-break contact 105. The predetermined level of pressure required to cause the pressure switch to break away from the solenoid-make contact is more than the pressure required to actuate the circuit relief valve 64, but less than the pressure required to actuate the component relief valve 98.

The electrical control circuit for actuating the solenoid 92 receives power from a battery 107 and is controlled by an operator's switch 108 that is normally open. When a hoist operator depresses the operator's switch, current normally flows through the pressure switch 102, the solenoid-make contact 104, a relay switch 109, and a contact 110 to the solenoid. If the pressure switch has been shifted to the circuit relay-break contact 105, current will flow from that contact, through a relay coil 111, to a ground G. The flow of current through the relay coil causes the relay switch 109 to open from the contact 110 and also causes a relay switch 112 to close upon a contact 113. Current then flows directly from the operator's switch, by-passing the pressure switch, to the relay switch 112, the contact 113, the relay coil 111, and the ground G. The relay switches could be eliminated by using a pressure switch with a dead band ratio greater than two to one for motors having a two to one displacement ratio.

When a load is being elevated by the fluid motor 72 at high speed, the directional valve 85 is in the second fluid circuit positon 87 and the operator's switch 108 is depressed. Should the pressure, developed by the load, within the second rotor section 74, as sensed by the pressure switch 102, exceed the predetermined level of the pressure switch, the switch will break away from the solenoid-make contact 104 and shift to a position contacting the circuit relay-break contact 105. The relay switch 109 is held open and the relay switch 112 is held closed upon the contact 113 by the relay coil 111. The solenoid 92 is de-energized and the directional valve 91 is returned by the spring 96 to the first position 93. Fluid from the pressure source 95 is blocked from the pilot line 89 and this line is allowed to drain through the valve to the sump tank 61. The spring 90 then returns the directional valve to the first fluid circuit position 86 for lifting the load at low speed. Thus, the pressure switch automatically cancels the influence of the operator's switch. By shifting to low speed, the pressure within the second rotor section will be reduced to a safe level but the relay switch 112, which enables the relay coil to remain energized, continues to hold the relay switch 109 open, until the operator's switch is opened. This prevents undesirable oscillations in the system, as would occur if the solenoid could be automatically energized to repeat the sequence of operation.

The circuit relief valve 64 is actuated by a pressure lower than the predetermined level required to actuate the pressure switch 102. This valve opens in response to such pressure and thereby prevents the pressure switch from being actuated by pressure coming from the pump 63. The pressure switch is actuated by a pressure level lower than the pressure required to actuate the component relief valve 98, and thus, will be actuated before that valve. The component relief valve limits the pressure spike that can occur in the time span required for the directional valve 85 to be shifted back to the position 86 for low speed operation. The actual time span for shifting the valve is normally a fraction of a second. Thus, very little fluid will be allowed to escape through the component relief valve, and the load being hoisted by the output shaft 75 will remain stable.

From the foregoing description, it will be seen that pressure protection is provided for the load hoisting components, such as the hoist cylinder 23 in the load hoisting system 10 and the fluid motor 72 in the load hoisting system 60, while maintaining load control. The pressure switches 42 and 102 automatically cancel the influence of the operator's switches 48 and 108 in response to excessive pressure. Undesirable oscillation in the automatic control systems is eliminated by the relay switches 49, 52, 109 and 112 or by using pressure switches with a sufficient dead band ratio.

Although the best mode contemplated for carrying out the present invention has been herein shown and described, it will be apparent that modification and variation may be made without departing from what is regarded to be the subject matter of the invention.

What is claimed is:

1. A control system for hoisting loads comprising a fluid motor with a pair of rotor sections drivingly connected to a common shaft that is operable at either a low speed or a high speed; a source of pressure fluid; a sump, a fluid circuit interconnecting the fluid source and the fluid motor, said fluid circuit including a valve controlling the flow to and from a single rotor section and having a low speed position wherein the discharge of said one rotor section is connected to sump and a high speed position wherein the discharge of said one rotor section is connected to the source side of said one rotor section for controlling the fluid motor speed, means biasing said valve to the low speed position; and means for shifting the valve from the low speed position to the high speed position, said valve shifting means including a solenoid for maintaining said valve in the high speed position when energized, an operator's switch, and an electrical circuit interconnecting the solenoid and the operator's switch, said operators's switch when closed being effective to energize the solenoid to maintain the valve in the high speed position, a pressure switch within the electrical circuit, said pressure switch being connected to the fluid circuit for sensing the fluid pressure therein near a pressurized side of the fluid motor, said pressure switch being operable in response to a predetermined pressure level within the fluid circuit for breaking the electrical circuit to the solenoid, whereupon the valve biasing means shifts the valve controlling the fluid motor speed to the low speed position.

2. The control system described in claim 1 wherein the fluid circuit includes a relief valve that is located between the source of pressure fluid and the pressure switch for limiting the fluid circuit pressure to an amount that is less than the predetermined pressure level controlling the pressure switch.

3. The control system described in claim 1, wherein the electrical circuit includes a stabilizing relay that is positioned between the pressure switch and the solenoid to prevent hunting therebetween.

4. The control system described in claim 1, wherein the pressure switch has a dead band ratio that is sufficient to prevent undesirable oscillations in the system.

5. A control system for hoisting loads comprising a fluid motor with a pair of rotor sections drivingly connected to a common shaft that is operable at either a low speed or a high speed; a source of pressure fluid; a sump, a fluid circuit interconnecting the fluid source and the fluid motor, said fluid circuit including a valve controlling the flow to and from a single rotor section and having a low speed position wherein the discharge of said one rotor section is connected to sump and a high speed position wherein the discharge of said one rotor section is connected to the source side of said one rotor section for controlling the fluid motor speed, means biasing said valve to the low speed position; and means for shifting the valve from the low speed position to the high speed position, said valve shifting means including a solenoid, an operator's switch, and an electrical circuit interconnecting the solenoid and the operator's switch, said operator's switch when closed being effective to energize the solenoid to maintain the valve in the high speed position, a pressure switch within the electrical circuit, said pressure switch being connected to the fluid circuit for sensing the fluid pressure therein near a pressurized side of the fluid motor, said pressure switch being operable in response to a predetermined pressure level within the fluid circuit for breaking the electrical circuit to the solenoid, whereupon the valve shifting means allows the biased valve controlling the fluid motor speed to revert to the low speed position, said valve shifting means further including a pilot line connected to the fluid motor speed control valve, a source of pilot pressure fluid, and a directional valve interconnecting the pilot line and fluid source, said directional valve being biased by spring means to a position where the pilot line is not pressurized but being controllable by the solenoid for movement to a position pressurizing the pilot line.

* * * * *

UNITED STATES PATENT OFFICE

CERTIFICATE OF CORRECTION

Patent No. 4,142,369 Dated March 6, 1979

Inventor(s) Roger D. MICKELSON

It is certified that error appears in the above-identified patent and that said Letters Patent are hereby corrected as shown below:

Col. 3, lines 52-58, delete "for dynamic forces. The velocity of the piston is equal to the flow supplied by the pump divided by the effective area of the piston which is the hydraulic component. Assuming that the cross-sectional area of the extend chamber is twice the effective cross-sectional area of the retract chamber, there would be a two to one rato between".

Signed and Sealed this

*Twenty-second* Day of *January 1980*

[SEAL]

*Attest:*

SIDNEY A. DIAMOND

*Attesting Officer* *Commissioner of Patents and Trademarks*